US005168193A

United States Patent [19]

Hoegler

[11] Patent Number: 5,168,193

[45] Date of Patent: Dec. 1, 1992

[54] LAMP HAVING BORON NITRIDE REFLECTIVE COATING

[75] Inventor: Leonard E. Hoegler, Solon, Ohio

[73] Assignee: General Electric Company, Schenectady, N.Y.

[21] Appl. No.: 769,131

[22] Filed: Sep. 30, 1991

[51] Int. Cl.[5] ..... H01J 5/16; H01K 1/32

[52] U.S. Cl. ..... 313/113; 313/47; 313/578; 362/296

[58] Field of Search ..... 313/113, 47, 45, 579, 313/578; 362/296

[56] References Cited

U.S. PATENT DOCUMENTS

| | | | |
|---|---|---|---|
| 2,135,732 | 11/1938 | Randall et al. | 313/113 X |
| 2,434,757 | 1/1948 | Cartun | 313/113 |
| 2,434,779 | 1/1948 | Willis | 313/113 |
| 4,281,267 | 7/1981 | Johnson | 313/47 X |
| 4,445,068 | 4/1984 | van Heel et al. | 313/113 |
| 4,467,238 | 8/1984 | Silverstein et al. | 313/113 X |
| 4,499,398 | 2/1985 | Munroe | 313/113 |
| 4,918,356 | 4/1990 | Enyedy et al. | 313/579 |

FOREIGN PATENT DOCUMENTS

| | | |
|---|---|---|
| 0001979 | 1/1979 | Japan . |

*Primary Examiner*—Donald J. Yusko
*Assistant Examiner*—Ashok Patel
*Attorney, Agent, or Firm*—Edward M. Corcoran; Stanley C. Corwin

[57] ABSTRACT

A coating of boron nitride disposed on a lamp arc tube or filament tube provides an integral reflector for reflecting light and heat emitted by the light source. One particularly useful application is linear, quartz incandescent heat lamps having a boron nitride coating disposed along one side of the filament chamber.

16 Claims, 3 Drawing Sheets

*Fig. 3(a)*
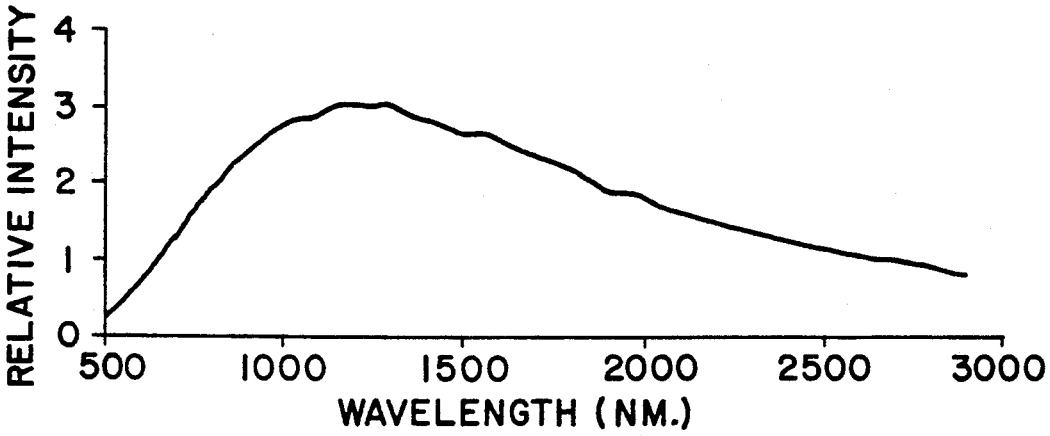
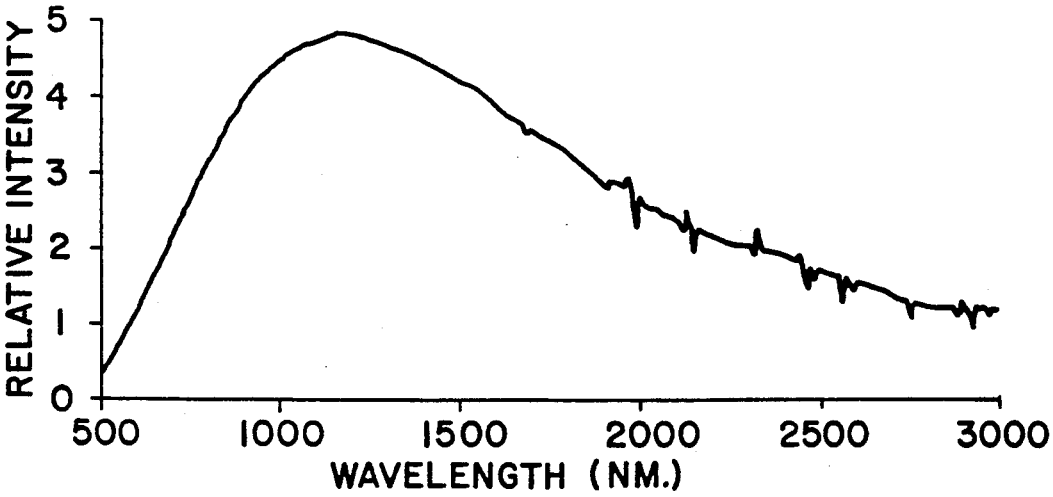
*Fig. 3(b)*

LAMP HAVING BORON NITRIDE REFLECTIVE COATING

BACKGROUND OF THE INVENTION

1. Field of the Invention

This invention relates to lamps having a boron nitride reflective coating. More particularly, this invention relates to an electric incandescent or arc discharge lamp including a light-transmissive envelope enclosing a filament or arc within wherein a boron nitride coating is disposed on a portion of the envelope surface.

2. Background of the Disclosure

Coatings which reflect both visible light radiation and infrared radiation have been used on various types of lamps for years. White, opaque, heat-resistant coatings containing refractory metal oxide such as zirconia, alumina, titania, etc., with a glass frit binder or a binder such as a mixture of boric acid and silica, have been used on the ends of arc tubes of high intensity discharge lamps, such as metal halide arc discharge lamps, to prevent ionized metal halide in the arc tube from condensing on the relatively cool ends of the arc tube. Similar coatings have been used on incandescent lamps, such as linear quartz heat lamps, wherein the coating is applied to a portion of the outer surface of the fused quartz lamp envelope as an integral reflector for reflecting both the visible and infrared radiation emitted by the filament. Using an integral reflective coating on half of the linear surface of the envelope of a heat lamp maximizes the radiant energy emitted in the direction of the object to be heated, while minimizing the radiant energy emitted from the opposite side. This enables one to use a smaller fixture in which the heat lamp is mounted, because less heat reflecting surface is needed in the fixture. Such fixtures usually have a polished metal or other reflecting surface which reflects heat emitted by the lamp in the intended direction. Multilayer, thin film light interference coatings have also been employed in various types of lamps as coatings for reflecting various portions of the spectrum, including infrared. All of these coatings are expensive, costly and difficult to apply. Hence there is a need for a heat resistant reflective coating that is relatively inexpensive, easy to apply and which will stand up under the high temperature conditions and thermal cycling that such coatings experience on incandescent and arc discharge lamps.

SUMMARY OF THE INVENTION

The present invention relates to an electric lamp including a light-transmissive envelope enclosing an arc discharge or filament within as a source of electromagnetic radiation, wherein a reflective coating comprising boron nitride is disposed on at least a portion of the envelope surface to reflect at least a portion of the radiation emitted by said source. In one embodiment the lamp will be an incandescent lamp, such as a linear, incandescent heat lamp wherein a filament is the radiation source which emits light and heat, and wherein the boron nitride reflective coating is disposed along one side of the light-transmissive lamp envelope enclosing the filament to reflect both the visible and infrared radiation emitted by the filament. In another embodiment the radiation source will be an arc discharge and the lamp will be an arc discharge lamp, such as a metal halide high intensity discharge lamp, which includes a light transmissive arc tube enclosing a fill hermetically sealed within for sustaining an arc discharge which emits light and heat and wherein one or both ends or other portion of the surface of the arc tube or chamber is coated with a boron nitride reflective coating. In one such embodiment the arc tube will contain a pair of spaced part electrodes within. In yet another embodiment the arc discharge lamp will be an electrodeless lamp with the boron nitride reflective coating disposed on a portion of the arc tube or arc chamber envelope for reflecting a portion of the light and heat emitted by the arc. By reflective coating is meant that the boron nitride coating reflects both visible light radiation and infrared radiation. By boron nitride coating is meant a coating comprising boron nitride, preferably at least 50 wt. % boron nitride and still more preferably at least 75 wt. % boron nitride.

BRIEF DESCRIPTION OF THE DRAWINGS

FIGS. 3(*a*) and 3(*b*) graphically illustrate relative intensity through the reflective coating as a function of wavelength for a heat lamp of the invention and one of the prior art, respectively.

DETAILED DESCRIPTION

As set forth above, this invention relates to an electric lamp having a light-transmissive envelope containing a source of light and heat within wherein a boron nitride coating is disposed on a portion of said envelope for reflecting visible and/or infrared radiation emitted by the light and heat source. In the context of this invention, a boron nitride reflective coating means a reflective coating in which boron nitride is a key and essential component. Such coatings will preferably contain at least 50 wt. % and more preferably at least 75 wt. % boron nitride. A commercially available material known as "Boron Nitride Lubricoat" useful for a coating of this invention may be obtained from the ZYP Corporation of Oak Ridge, Tenn. This is a water based mixture of boron nitride and alumina, white in appearance, which is sold as a high temperature lubricant and release agent for glass and non-ferrous melting/casting industries. It is available as 75 wt. % boron nitride and 25 wt. % alumina and also as 87.3 wt. % boron nitride with an alumina content of 12.7 wt. % and may be applied to lamp envelopes by dip coating, brushing or spraying. Water may be used for thinning. The resulting coating is white in appearance. Multiple coats can be applied to yield the desired thickness. Although the coating as applied is fragile and can be easily removed with a fingernail, a tougher coating more resistant to abrasion and physical removal is obtained by heating the coated lamp. Energizing a heat lamp on which it has been applied provides sufficient heat to achieve a coating more resistant to abrasion and physical removal. This boron nitride coating material has been applied to linear quartz heat lamps which have been operated for over 1500 hours of service in air with no signs of coating deterioration, discoloration or loss of adhesion to the quartz envelope even at temperatures up to 1000° C. Those skilled in the art will recognize that suitable coating formulations may also be made by mixing a boron nitride powder with other materials such as glass frits, high temperature pigments, refractory metal oxides, etc. Thus, in the context of the invention by boron nitride coating is meant a coating that includes or comprises boron nitride, preferably one that has at least 50 wt. % boron nitride, and more preferably at least 75 wt. %.

Figure 1B:
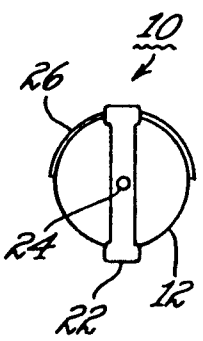
FIGS. 1(*a*) and 1(*b*) schematically illustrate a linear, fused quartz or quartz heat lamp wherein a boron nitride coating is disposed along a portion of the outer surface of the lamp envelope.
Figure 1A:
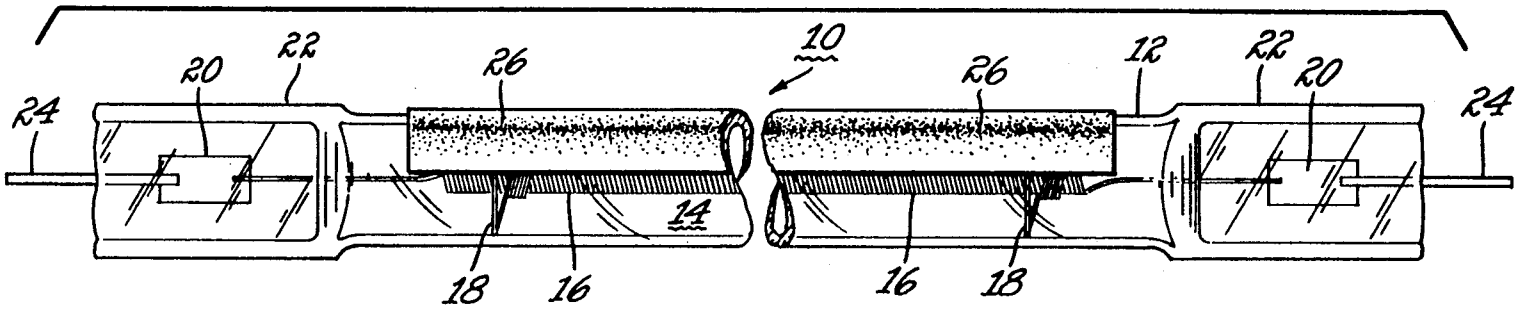
Figure 2:
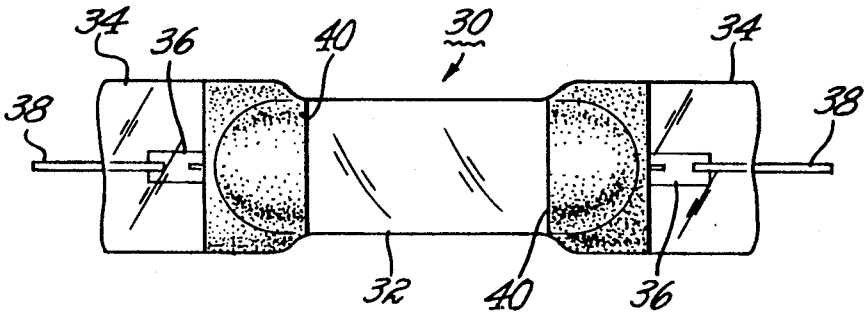
FIG. 2 schematically illustrates an arc lamp wherein a boron nitride coating is disposed at each end of the arc chamber or tube for minimizing condensation of metal halide.

Turning to FIGS. 1(*a*) and 1(*b*), there is schematically illustrated lamp 10 comprising light-transmissive envelope 12 which, in this case is a vitreous material made of fused quartz. Envelope 12 contains filament chamber 14 within in which is hermetically sealed coiled tungsten filament 16 longitudinally disposed within chamber 14 so that the longitudinal axis of filament 16 is coincident with the longitudinal axis of chamber 14. Filament 16 is supported within chamber 14 by means of a plurality of tungsten or tantalum coiled wire filament supports 18. Filament 16 is welded or brazed at each end to molybdenum foil seals 20 hermetically sealed into press seal portions 22. Outer lead wires 24 exit lamp 10 and are also attached at one end to foil seals 20. A reflective coating 26 comprising boron nitride is disposed on slightly less than one-half of the outer surface of the filament chamber portion 14 of lamp envelope 12. FIG. 2 schematically illustrates an arc lamp 30 comprising a light-transmissive vitreous quartz envelope 32 enclosing within an arc chamber having hermetically sealed therein a pair of spaced apart electrodes and an arc sustaining fill comprising one or more metal halides and mercury (not shown). Arc lamp 30 terminates at both ends in press seal portions 34 which hermetically seal within molybdenum foil seals 36 attached at one end to electrodes (not shown) and at the other end to outer leads 38. Arc lamp 30 contains coating 40 comprising boron nitride disposed at both ends for minimizing or avoiding condensation of the metal halide at the end of the arc chamber during operation of the lamp. As set forth above, the boron nitride coating will also be useful in association with coating a portion of the arc tube or arc chamber of electrodeless lamps in order to reflect radiation emitted by the arc therein in a desired direction and/or minimize radiation from being emitted in a direction which is not desired. Further, the reflective boron nitride coating 40 may be disposed on yet other portions of arc lamp 30 for directing or reflecting the radiation emitted by the arc. Thus, this illustration is not intended to limit the invention to an embodiment for an arc discharge lamp wherein a coating is limited to being disposed on each end of the arc tube or chamber.

Although the foregoing illustrative embodiments have all been related to electric lamps, the invention is also useful with lamps having a flame as the source of radiation.

The invention will be further understood with reference to the examples below.

EXAMPLES

Figure 4A:
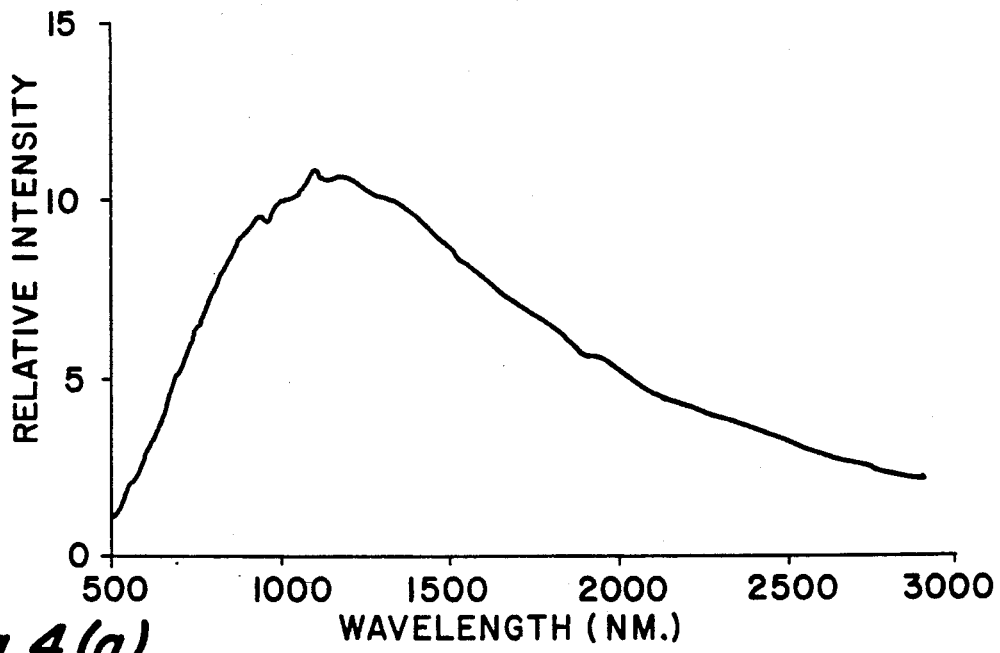
FIGS. 4(*a*) and 4(*b*) graphically illustrate relative emission intensity emitted through the uncoated side of the lamp as a function of wavelength, for a heat lamp of the invention and one of the prior art, respectively.
Figure 4B:
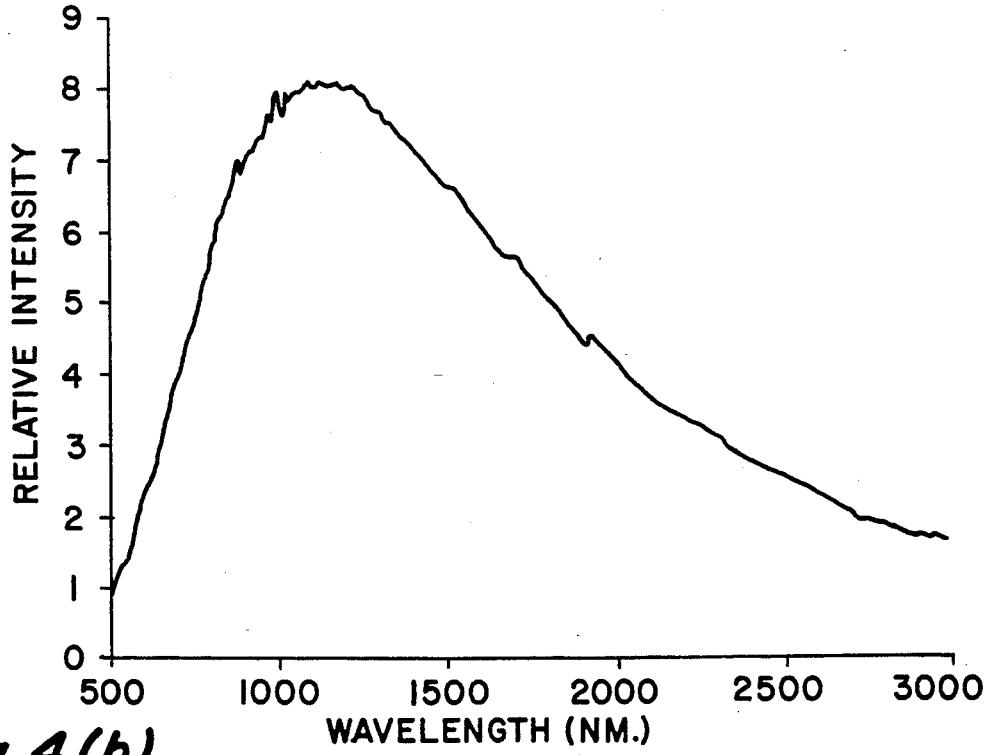

Heat lamps of the invention nominally rated at 240 volts and 2000 watts were made as illustrated in FIG. 1 having an overall length of 13½ inches, including the press seal end portions, with a filament chamber about 12 inches long hermetically enclosing within a coiled tungsten filament 10¼ inches long supported within the filament chamber by 13 spiral filament supports which were made out of tantalum. A boron nitride reflective coating 10¼ inches long and containing 87.3 wt. % boron nitride and 12.7 wt. % alumina in a water vehicle was applied by spraying Boron Nitride Lubricoat to one side of the filament chamber. The coating was disposed behind the filament, as shown in FIGS. 1(*a*) and 1(*b*), to provide an integral heat and light reflecting coating. After spraying, the coated lamps were permitted to dry in air and were then energized in order to "cure" the coating so that it was more resistant to mechanical removal and damage. The coating was a white, opaque coating through which the filament could not be seen. The lamps were then energized at a voltage of 220 volts and the relative energy transmitted by the filament was measured by a spectroradiometer. FIG. 3(*a*) graphically illustrates the relative energy emission intensity as a function of wavelength which was transmitted through the coating. A number of competitive 240 volt and 2000 watt heat lamps of the same size and construction as the lamps of the invention, but containing a prior art coating (which was analyzed and found to consist primarily of titania and lead with small amounts of alumina and silica, but with no boron) were also energized and spectroradiometer measurements taken to measure the energy transmitted. FIG. 3(*b*) illustrates the relative emission intensity through the coating as a function of wavelength of these prior art competitive lamps. One can readily see by comparing the two Figures that substantially less energy was emitted through the coating of the present invention as compared with the competitive, proprietary lamps containing the prior art coating. Emission measurements were also taken from both types of lamps at a point opposite the coating. That is, the measurements were taken of emission opposite the coating and through the uncoated side of the filament chamber, which included that emitted by the filament and that reflected by the coatings. FIGS. 4(*a*) and 4(*b*) graphically illustrate the relative energy emission of the lamp containing the boron nitride reflective coating of the invention and that of the prior art lamp, respectively. One immediately sees at least a greater than 20% improvement in energy emitted by the lamp in the desired direction employing the boron nitride coating of the invention compared to the prior art lamp.

I claim:

1. An electric lamp comprising a light-transmissive envelope enclosing an electric source of light and heat and having a coating comprising boron nitride disposed on at least a portion of said envelope for reflecting at least a portion of said light and heat emitted by said source.

2. The lamp of claim 1 wherein said coating contains at least 50% boron nitride.

3. The lamp of claim 2 wherein said coating comprises at least 75% boron nitride.

4. An arc discharge lamp comprising a hermetically sealed light-transmissive envelope containing a fill for sustaining an arc discharge and means for creating and sustaining said arc discharge and having a heat and light reflecting coating comprising boron nitride disposed on at least a portion of the surface of said envelope.

5. The lamp of claim 4 wherein said arc discharge emits both heat and light at least a portion of which is reflected by said coating.

6. The lamp of claim 4 being an electrodeless arc discharge lamp.

7. The lamp of claim 4 wherein said coating comprises at least 50 wt. % boron nitride.

8. The lamp of claim 7 wherein said coating comprises at least 75 wt. % boron nitride.

9. The lamp of claim 7 being an electrodeless arc discharge lamp.

10. The lamp of claim 4 wherein said arc chamber contains a pair of spaced apart electrodes.

11. The lamp of claim 10 wherein said coating comprises at least 50 wt. % boron nitride.

12. The lamp of claim 11 wherein said coating comprises at least 75 wt. % boron nitride.

13. The lamp of claim 12 being an electrodeless arc discharge lamp.

14. An incandescent lamp comprising a light-transmissive envelope having a filament chamber enclosing within a filament which emits both visible light radiation and heat wherein a reflective coating comprising boron nitride is disposed on at least a portion of the surface of said filament chamber for reflecting at least a portion of said light and heat emitted by said filament.

15. The lamp of claim 14 wherein said coating comprises at least 50 wt. % boron nitride.

16. The lamp of claim 15 wherein said coating comprises at least 75 wt. % boron nitride.

* * * * *